United States Patent [19]

Hayes

[11] Patent Number: 4,745,248

[45] Date of Patent: May 17, 1988

[54] METHOD OF HEATING AND STORING LIQUIDS

[76] Inventor: Charles S. Hayes, 1634 E. Jefferson Blvd., South Bend, Ind. 46617

[21] Appl. No.: 897,583

[22] Filed: Aug. 18, 1986

[51] Int. Cl.[4] ..... H05B 6/64

[52] U.S. Cl. ..... 219/10.55 M; 219/10.55 E; 219/343; 219/386; 99/DIG. 14; 432/9

[58] Field of Search ..... 219/10.55 E, 10.55 A, 219/10.55 M, 10.55 R, 385, 386, 387, 343; 426/241, 243; 432/9, 10; 99/DIG. 14

[56] References Cited

U.S. PATENT DOCUMENTS

| | | | |
|---|---|---|---|
| 3,585,357 | 6/1971 | Mandell | 219/387 X |
| 4,008,347 | 2/1977 | Amberg et al. | 220/457 X |
| 4,198,559 | 4/1980 | Walter et al. | 219/387 |
| 4,307,277 | 12/1981 | Maeda et al. | 219/10.55 R |
| 4,409,454 | 10/1983 | Beauvais et al. | 219/10.55 E |
| 4,523,078 | 6/1985 | Lehmann | 219/386 X |

*Primary Examiner*—Philip H. Leung
*Attorney, Agent, or Firm*—Polster, Polster & Lucchesi

[57] ABSTRACT

A method of heating and maintaining the temperature of heated liquids which involves storing liquid receptacles in an insulated container, then heating the liquid in the receptacles to a desired temperature. The insulated container may include a wrapper member which functions as a carrying handle for the insulated container.

3 Claims, 2 Drawing Sheets

METHOD OF HEATING AND STORING LIQUIDS

SUMMARY OF THE INVENTION

This invention relates to a method of heating and maintaining the temperature of heated liquids, and to a container for carrying out the principal steps of the method.

Previous methods of maintaining elevated temperatures in stored liquids were very inefficient. Such methods usually involved heating the liquid then transferring the liquid receptacle to an insulated storage container. Heat loss during transfer and the decreased temperature of the storage container caused the stored liquid to cool too rapidly.

The method of this invention involves placing the liquid receptacle into an insulated storage container prior to heating. After heating, the storage container may be allowed to set for a short period of time to equalize the internal temperature where the liquid receptacles are located.

Accordingly, it is an object of this invention to provide for an improved method of maintaining the temperature of heated liquids.

Another object of this invention is to provide for a method of heating liquid in containers which is efficient and economical.

Another object of this invention is to provide for a container which stores heated liquids and is easy to carry.

Other objects of this invention will become apparent upon a reading of the following description.

DESCRIPTION OF THE PREFERRED EMBODIMENT

The preferred method and device described herein are not intended to be exhaustive or to limit the invention to the precise form or steps disclosed. They are chosen and described to illustrate the principles of the invention and its application and practical use to thereby enable others skilled in the art to utilize the invention.

Figure 2:
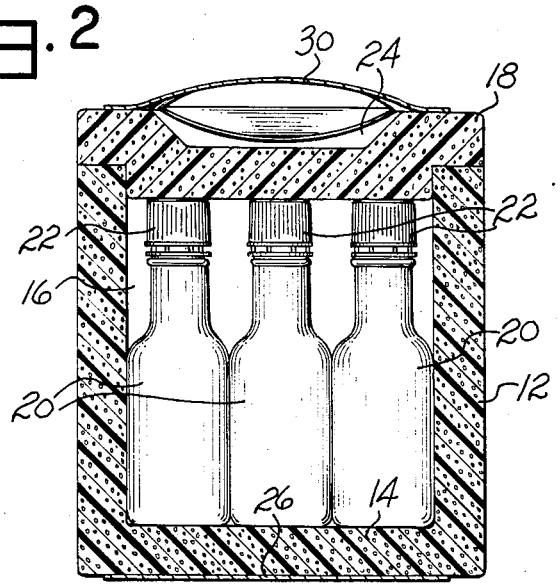
FIG. 2 is a sectional view taken along line 2—2 of FIG. 1 with the user's hand removed.
Figure 3:
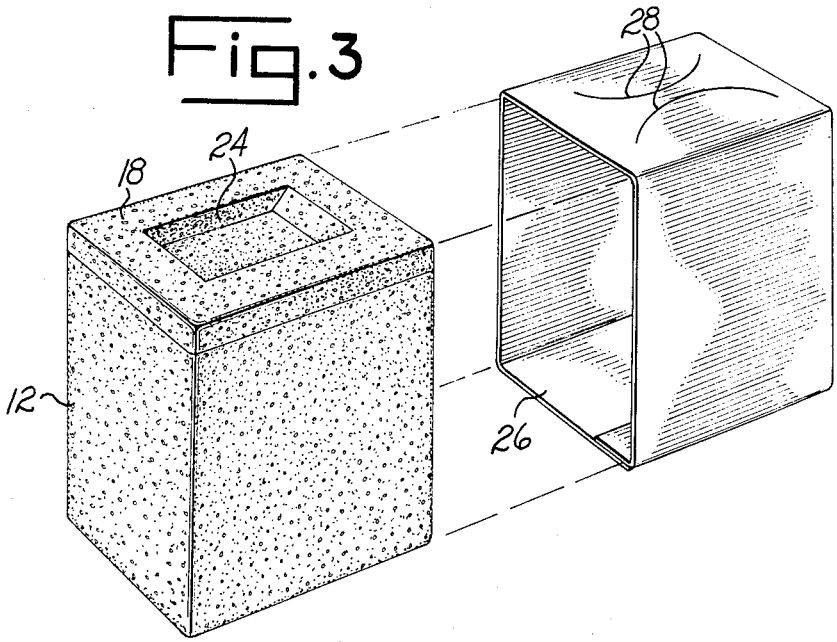
FIG. 3 is a perspective view of the insulated container and wrapper member shown in separated form.
Figure 4:
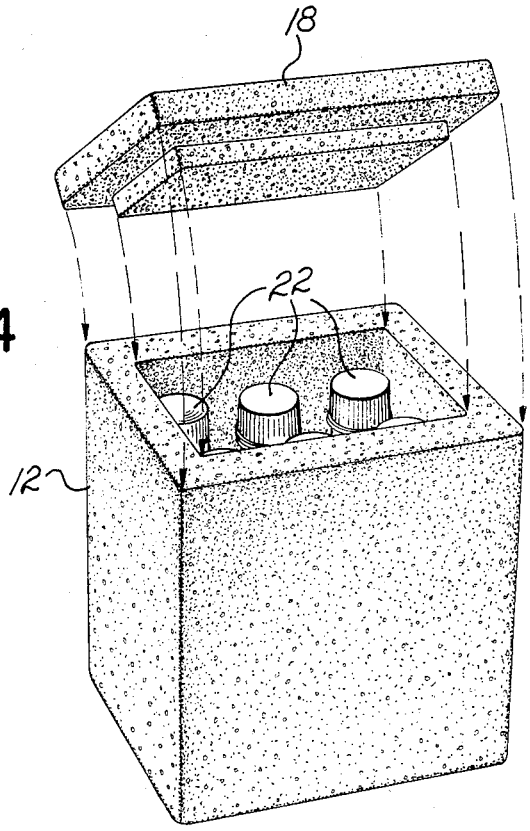
FIG. 4 is a perspective view of the insulated container with its top removed.

Referring now to the drawings, reference numeral 10 refers generally to the insulated container of this invention. Container 10 includes an integral continuous side wall 12 and a bottom wall 14 to form a storage compartment 16. A removable top 18 forms a part of container 10 and covers and seals storage compartment 16. Container 10 is preferably formed of lightweight insulative material such as expanded polystyrene. As shown in FIGS. 2 and 4, a plurality of receptacles such as bottles 20 may be stored within storage compartment 16. Bottles 20 are preferably sealed by a screw on lid 22 and may contain a liquid for human consumption.

In the preferred embodiment, container top 18 has a recess 24 formed in its outer surface. A substantially continuous wrapper member 26 formed of paper, plastic, or similar flexible material is fitted about container

Figure 1:
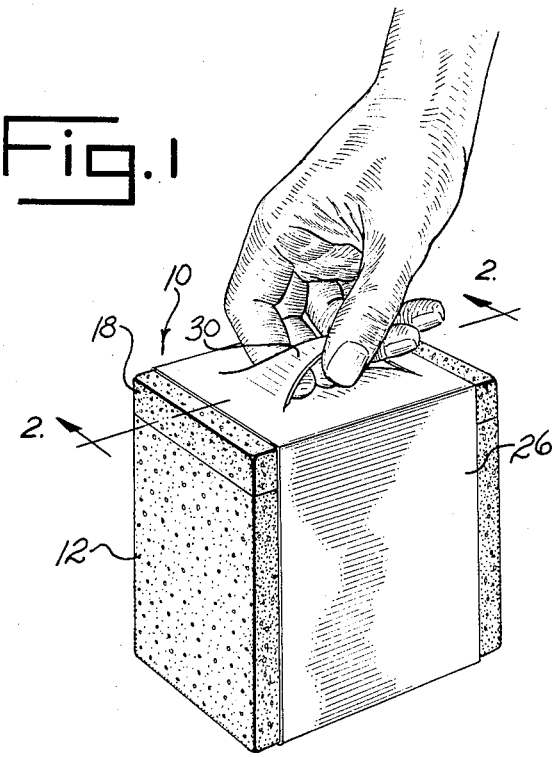
FIG. 1 is a perspective view of the insulated beverage container which illustrates use of the carrying handle.

10 as shown in FIG. 1 to retain top 18 in sealed form over storage container 16. Wrapper member 26 includes arcuate slits 28 which are positioned side by side adjacently above top recess 24 to form a handle 30 and allow container 10 to be carried in a tote fashion as shown in FIG. 1. Wrapper member 26 is of sufficient strength to permit container 10 with receptacles 20 to be carried and later removed to allow access to the receptacles.

The preferred method of heating the consumable liquids in bottles 20 includes positioning the bottles in container storage compartment 16 and sealing the compartment by top 18. The bottle liquids in sealed container 10 are then heated such as by microwave energy to a desired temperature for a certain time and then allowed to set an ambient temperature until the internal temperature of the liquids in bottles 20 has equalized. The insulative nature of container 10 maintains the desired liquid temperature in bottles 20 until the container is opened and the liquid is consumed. The following example is illustrative of the process.

Example

A container was constructed according to the principles outlined above (polystyrene wall 0.625 inches thick). Six sealed bottles containing a buttered rum beverage were placed into the container storage compartment and the compartment sealed by the container top. The container and bottles were then placed in a 500 watt microwave oven and heated at full power for two minutes. The container was removed with the temperature of the bottle liquid observed to be 175° F. After setting at ambient temperature (approximately 68° F.) for ninety minutes the bottles were removed from the container with their liquid temperature recorded to be 135° F.

It is understood that the above description is not intended to limit the invention to the given details, but the invention may be modified within the scope of the following claims.

I claim:

1. A method of maintaining the temperature of heated liquids comprising the steps of:

(a) providing an insulated lightweight container capable of permitting ready hand toting which includes a removable nesting top to provide a closable internal storage compartment, all of lightweight insulative material and a sealing and carrying member associated therewith;

(b) placing at least one receptable carrying a consumable liquid to be heated in said storage compartment and closing the compartment with said nesting top to snugly retain said receptacle in position within said storage compartment;

(c) externally heating from a heat source positioned externally of said container said liquid in said receptacle within said closed insulative storage compartment with the liquid in the receptacle reaching a desired temperature above consumption temperature; and (d) allowing said insulated container to set at ambient temperature for a time within said closed storage compartment wherein the liquid in said receptacles cools slowly to allow ready hand toting of said container by said sealing and carrying member and consumption of said liquid in said receptable in a heated condition.

2. The method of claim 1 wherein step (c) includes heating by microwave energy.

3. The method of claim 1, including placing a plurality of closed receptacles, each carrying a consumable liquid to be heated in said storage compartment in closed heat conductive relation to each other and snugly retaining said closed receptacles in hand toting position with said nesting top.

* * * * *